US009187153B2

(12) United States Patent
Lavagna et al.

(10) Patent No.: US 9,187,153 B2
(45) Date of Patent: Nov. 17, 2015

(54) MOORING SYSTEM WITH DECOUPLED MOORING LINES AND/OR RISER SYSTEM

(71) Applicant: SINGLE BUOY MOORINGS INC., Marly (CH)

(72) Inventors: Philippe Lavagna, Monaco (MC); Xavier Connaulte, Houston, TX (US); Christoph Vogt, Monte Carlo (MC)

(73) Assignee: SINGLE BUOY MOORINGS INC., Marly (CH)

( * ) Notice: Subject to any disclaimer, the term of this patent is extended or adjusted under 35 U.S.C. 154(b) by 0 days.

(21) Appl. No.: 14/291,030

(22) Filed: May 30, 2014

(65) Prior Publication Data

US 2014/0261131 A1 Sep. 18, 2014

Related U.S. Application Data

(62) Division of application No. 13/256,761, filed as application No. PCT/EP2010/053535 on Mar. 18, 2010, now Pat. No. 8,851,004.

(30) Foreign Application Priority Data

Mar. 18, 2009 (EP) ..... 09155471

(51) Int. Cl.

| | |
|---|---|
| ***B63B 21/26*** | (2006.01) |
| ***B63B 22/02*** | (2006.01) |
| ***B63B 21/50*** | (2006.01) |

(52) U.S. Cl.

CPC ..... *B63B 22/02* (2013.01); *B63B 21/507* (2013.01); *B63B 21/508* (2013.01); *B63B 22/026* (2013.01)

(58) Field of Classification Search

CPC .... B63B 21/508; B63B 21/507; B63B 22/023
See application file for complete search history.

(56) References Cited

U.S. PATENT DOCUMENTS

| | | | |
|---|---|---|---|
| 5,339,760 | A | 8/1994 | Korsgaard |
| 5,651,708 | A | 7/1997 | Borseth |
| 5,823,131 | A | 10/1998 | Boatman et al. |
| 5,860,840 | A | 1/1999 | Boatman et al. |
| 6,631,745 | B2 | 10/2003 | Fontenot et al. |
| 2002/0117098 | A1 | 8/2002 | Boatman |
| 2004/0261682 | A1 | 12/2004 | Lindblade |
| 2007/0155259 | A1 | 7/2007 | Van Tol et al. |

FOREIGN PATENT DOCUMENTS

| | | |
|---|---|---|
| WO | 9930963 | 6/1999 |
| WO | 2009141351 | 11/2009 |

OTHER PUBLICATIONS

International Search Report dated Jun. 8, 2011, from corresponding PCT application.

*Primary Examiner* — Edwin Swinehart
(74) *Attorney, Agent, or Firm* — Young & Thompson

(57) ABSTRACT

A vessel includes a hull with a turret, a cavity in the turret and a mooring buoy releasably attached in the cavity, the buoy including a buoyant body and carrying a number of risers, extending to a subsea hydrocarbon well and a number of anchor lines connected to the sea bed, wherein upon connection of the buoy to the cavity, the buoy is attached to a pulling member connected to a winch on the vessel for lifting of the buoy. Each anchor line and/or riser at its upper end is connected to a stopper member, the stopper member being attached to the pulling member, wherein during lifting, each anchor line and/or riser and the stopper member are movable relative to the buoyant body in a length direction of the anchor lines and/or risers, and wherein after connection of the buoyant body to the cavity, the stopper member is engaged with an abutment member on the buoyant body to support the anchor line and/or riser weight off the body.

2 Claims, 6 Drawing Sheets

MOORING SYSTEM WITH DECOUPLED MOORING LINES AND/OR RISER SYSTEM

FIELD OF THE INVENTION

The invention relates to a vessel comprising a hull having a turret, a cavity in the turret and a mooring buoy releasably attached in the cavity, the buoy comprising a buoyant body and carrying a number of risers extending to a subsea hydrocarbon well and a number of anchor lines connected to the sea bed, wherein upon connection of the buoy to the cavity, the buoy is attached to a pulling member connected to a winch on the vessel for lifting of the buoy.

BACKGROUND OF THE INVENTION

Such a disconnectable mooring system is disclosed in U.S. patent application US2007/155259. The known system includes a buoy that is provided with a conical outer casing and a corresponding conical cavity or receptacle on the vessel's turret structure, which cavity has a cone shape corresponding to the conical outer casing of the buoy member. The turret structure includes a turntable carrying conduits to be connected to the risers, wherein the turntable is supported on a bearing assembly in a manner allowing rotation with respect to the turret structure to align the conduits with the risers on the buoy only after the buoy is received and locked in the cavity of the turret structure. In this publication it is shown that only a main turret upper roller ball bearing assembly supports the turntable; this assembly includes three mutually movable parts that are directly interconnected to each other. In fact, this upper turret bearing assembly consists of 2 roller ball bearings that are directly placed on top of each other and interconnected via one common inner bearing housing member. This upper bearing assembly has therefore become a very critical and essential part of a weathervaning system. A disadvantage of this combined and interconnected roller ball bearing assembly is that if one or more roller balls fails, the complete assemble has to be changed out, meaning that the turret system cannot function anymore as a weathervaning system. This change out cannot be done offshore.

The known combined roller bearing system, due to the fabrication limitations, is limited to about only 8 meters, so that it not suitable for large disconnectable turret-buoy systems with for example 20 or more risers connected to the buoy.

Another patent publication that describes a disconnectable mooring system that is provided with two separate bearing systems, one of which is used only for rotating a turntable in order to align the manifold pipe ends with the riser ends of a connected buoy, is U.S. Pat. No. 5,651,708. This patent shows a disconnectable buoy that is provided with a bearing system that stays with the boy when disconnected. The buoy is rotatable connected to the moonpool of a vessel under the waterline without the use of a turret. An additional upper bearing system is disclosed at deck level, which supports a turntable with manifold, so that after the buoy is connected directly to the moonpool of the vessel, the turntable can be aligned with the risers of the connected buoy. The turntable is supported by the bearing system, so that even during production when hydrocarbons are received through the flexible piping connecting the manifold and the buoy, the turntable can be rotated at all times and be aligned with the buoy. When the twisting angle in the flexible piping between the buoy and the turntable is exceeded, the turntable is rotated by means of a connected motor driven pinion to a new position neutralizing the twisting. This system is therefore not advantageous for disconnectable turret-buoys systems sized to receive numerous of risers, and of course is not possible when using only hard piping.

Another disconnectable mooring system is described in U.S. patent publication US5823131. This patent discloses a disconnectable riser buoy for supporting only risers or riser lines, but with no mooring lines attached to it.

This riser buoy can be docked within a rotatable turret placed in a moonpool of a floating vessel and carries risers that are connected to flow paths, which are removably coupled to vessel product lines at a position above sea level. When the riser buoy is disconnected from the turret, it is maintained at a submerged depth in the sea by a weight attached to a buoy anchor leg that can be lowered down to the sea floor or raised within the turret. The turret is directly anchored to the sea floor via multiple mooring lines that are connected to the lower turret. When the riser buoy is released, the weight connected to the riser buoy, once resting on the sea floor, will moor the riser buoy and as such limit the excursions of the risers within acceptable limits. Further, as the mooring legs are directly connected to the turret, the riser buoy has only sufficient buoyancy to support the risers.

Another major aspect of this concept is that in order to dock the riser buoy, a retrieval line is pulled upwardly via a winch until the weight contacts the buoy. Then, buoy and weight are hooked up together, the weight being in contact with the bottom of the riser buoy and both riser buoy and weight are placed within the moonpool of the vessel. The main purpose of this system is to allow for hook-up of a pre-installed riser buoy before installation of the vessel and prior to connecting the mooring lines to the turret takes. The known mooring system does not function as a quick disconnectable system that is suitable to be used in cyclone areas or ice infested waters as the mooring legs stays connected to the turret. Also hook-up of both the riser supporting buoy and the weight together is only possible for relatively small buoys and weights and not for large buoys with large connected weights, as this would require a winch capacity exceeding the capacity of winches available in the field and involving the danger of creating large snap-loads in the hauling-in line that connects the buoy and the winch. This results in large winches that are designed to withstand such snatch loads.

In these known systems the capability to reconnect a buoy to a turret is mainly limited by the sea state and winch capacity. When the buoy is brought upwards to the turret for reconnection purposes, the heave motions of the buoy are coupled to those of the vessel when the buoy approaches its connect position. If the sea states are too large, snatch loads and buoy acceleration forces are exerted on the connection lines that exceed the strength of available reconnection lines. This is especially the case for large size buoys, for instance carrying 20 risers or more.

It is therefore an object of the present invention to provide a disconnectable turret-mooring buoy design having an increased reconnection capability even in severe sea states of for example up to 6 m significant wave height.

It is a further object of the present invention to provide a quick disconnectable and easy connectable mooring buoy system for a large numbers of risers and mooring legs, in which snatch loads on the pull-in line are reduced.

It is a further object of the present invention to provide a disconnectable mooring buoy system, which can operate with winches or reconnection chain jacks of reduced size.

The system according to the invention should readily connect and disconnect even in very severe environmental conditions to a floating vessel, for example a floating production unit (FPU or FPSO), using a conventional pull-in line, such as a chain. The buoy should provide accommodation for a large number of risers, for example at least 20 risers and 10 umbilicals, in a turret to which the mooring buoy can be connected. The system according to the present invention should ensure a high availably of the system under all weather conditions and minimize the down time before reconnection even considering the constant severity of the environment.

SUMMARY OF THE INVENTION

Hereto a vessel in accordance with the present invention is characterized in that each anchor line and/or riser at its upper end is connected to a stopper member, the stopper member being attached to the pulling member, wherein during lifting the chains and stopper member are movable relative to the buoyant body in a length direction of the anchor lines and/or risers, and wherein after connection of the buoyant body to the cavity the stopper member is engaged with an abutment member on the buoyant body to support the anchor line and/or riser weight off the body.

Because the heave-induced motions of the buoyant body of the buoy are during connection decoupled from the risers of the lateral mooring system and/or from the riser system, the maximum tension in the pull-in line or reconnection chain or cable is only determined by the lateral mooring system and riser system components, which involve known entities such as pretension, vertical stiffness and dynamic behaviour. These components can be modified and optimized with a larger degree of freedom as by the decoupling, the maximum tension in the pull-in line during reconnection is reduced. This is also important for the chain jack or winch design in case the pull in line is formed by a chain.

Because the maximum tension in the pull-in line is no longer influenced by the mass and added mass of the buoyant body, which is frequency dependent, large dynamic loads in the pull-in line are avoided. Therefore, the size of the buoyant body can be increased without restrictions in order to accommodate larger riser systems in case the system is pulled in through the mooring line fairleads on the buoy or to accommodate larger mooring systems in case the system is pulled in through the riser porches on the buoy.

Dynamic tension amplification in the pull-in line during reconnection, will be significantly reduced due to the relatively low vertical stiffness and added mass of the lateral mooring system. This will allow a larger reconnection sea-state.

During disconnecting the buoy from the cavity, the decoupling mechanism according to the invention will not be active as the lateral mooring line fairleads will rest on the buoyant body and no relative motions will be allowed. The mooring line pretension and riser hung weight results in a vertical payload that after disconnecting the buoy from the cavity in the hull of the vessel, will bring the buoy to the predetermined water depth, in a way similar to that of known mooring buoys.

In an embodiment the buoyant body comprises one or more substantially vertical channels with at a lower end anchor line/riser guides for guiding the anchor lines and/or risers through the at least one channel in a vertical direction from a lower end of the buoyant body to an upper end of the buoyant body, the anchor lines and/or risers being at the upper end of the buoyant body connected to the stopper member which is engageable with an abutment member at the top of the buoyant body for preventing movement of the stopper member into the at least one channel.

Upon reconnecting the buoy, the anchor lines and/or risers are lifted via the pull-in line, while the buoyant body rises upwards in view of its buoyancy and is able to move relative to the anchor lines and/or risers. This decouples the heave movements of the buoyant body from the pull-in line and reduces snatch load on the pull-in line. After connection of the buoyant body to the cavity in the hull of the vessel, the weight of the anchor lines and/or risers comes to hang from the buoyant body because these descend in the buoyant body until the stoppers are engaged with the abutment members on the buoyant body.

The stopper member may comprise a circular frame attached to the pulling member. The anchor lines and/or risers may be suspended from the frame and the lower end of the buoy may be provided with guides comprising sheaves that are placed on a circular frame at the bottom of the buoy. The buoyant body of the buoy that is to be latched into the cavity upon reconnection may comprise substantially vertical channels and the anchor lines and/or risers are deflected from their natural angle to extend in a substantially vertical orientation by the sheaves, the buoyant body during upward travel of the buoy being able to move up and down relative to the anchor lines and/or risers.

The buoyant body may comprise a number of substantially vertical frame members extending through vertical channels to a lower part of the buoyant body, wherein anchor lines and/or risers are attached to the frame members and are displaceable in a vertical direction together with the frame members, the lower end of the frame members terminating in an abutment member for engaging with the buoyant body and defining the lower position of the stopper member relative to the buoyant body.

The frame members can move up and down the vertical channels during raising of the buoy into the cavity via the pulling member that is attached to the frame member while the buoyant member is allowed to rise upwards in view of its buoyancy. After connection of the buoyant body to the cavity, stoppers on the vertical frame members are in their lowermost position abutting against the abutment member of the buoyant body.

In again an alternative embodiment, the buoyant body comprises a number of tracks, the pulling member comprising a number of lines running from the top of the buoyant body to each anchor line and/or riser via the tracks and connected to the stopper members which may be displaced over a length of the tracks, the buoyant body comprising a lower abutment member with which the stopper members may be engaged.

The pulling member is via the lines directly connected to the anchor lines and/or risers and pulls the lines or risers upwards, while the buoyant body can travel up and down along the lines during connection for decoupling the buoyant body movement from the anchor lines and/or risers.

In order to prevent yaw motions relative to the anchor lines and risers when the buoy is in its submerged, disconnected state, a lower abutment member on the buoyant body can engage in a non-rotatable manner with stopper members.

In an alternative embodiment, the snatch loads in the pull-in line are reduced by connecting the pull-in line to the buoy via a compression device. The compression device may comprise a resilient member such as rubber pads or a spring, and pulls downward on the pull-in line when the pull-in line goes slack due to downward heave movements of the vessel. In this way the pull-in member remains taut and snatch loads are reduced.

The compression device may comprise a lower flange and a compression spring extending between the flanges, the pulling member being attached to the lower flange, the upper flange being engageable with a stop member upon lifting of the buoy, the spring being compressible by upward movement of the lower flange by the pulling device.

In order to prevent the pull-in line from damaging the top of the buoy when the pull-in line goes slack upon connection and/or disconnection of the buoy to the cavity, the pull-in line may near a top part of the buoyant body be provided with a flexible sheath. In case the pull-in line is formed by a chain, the sheath may be in the form of a flexible hose slightly larger than the chain width to keep the chain at a distance from the buoy when the pull-in line goes slack.

BRIEF DESCRIPTION OF THE DRAWINGS

Some embodiments of a vessel in accordance with the present invention will be explained in detail with reference to the accompanying drawings. In the drawings.

DETAILED DESCRIPTION OF THE INVENTION

Figure 1:
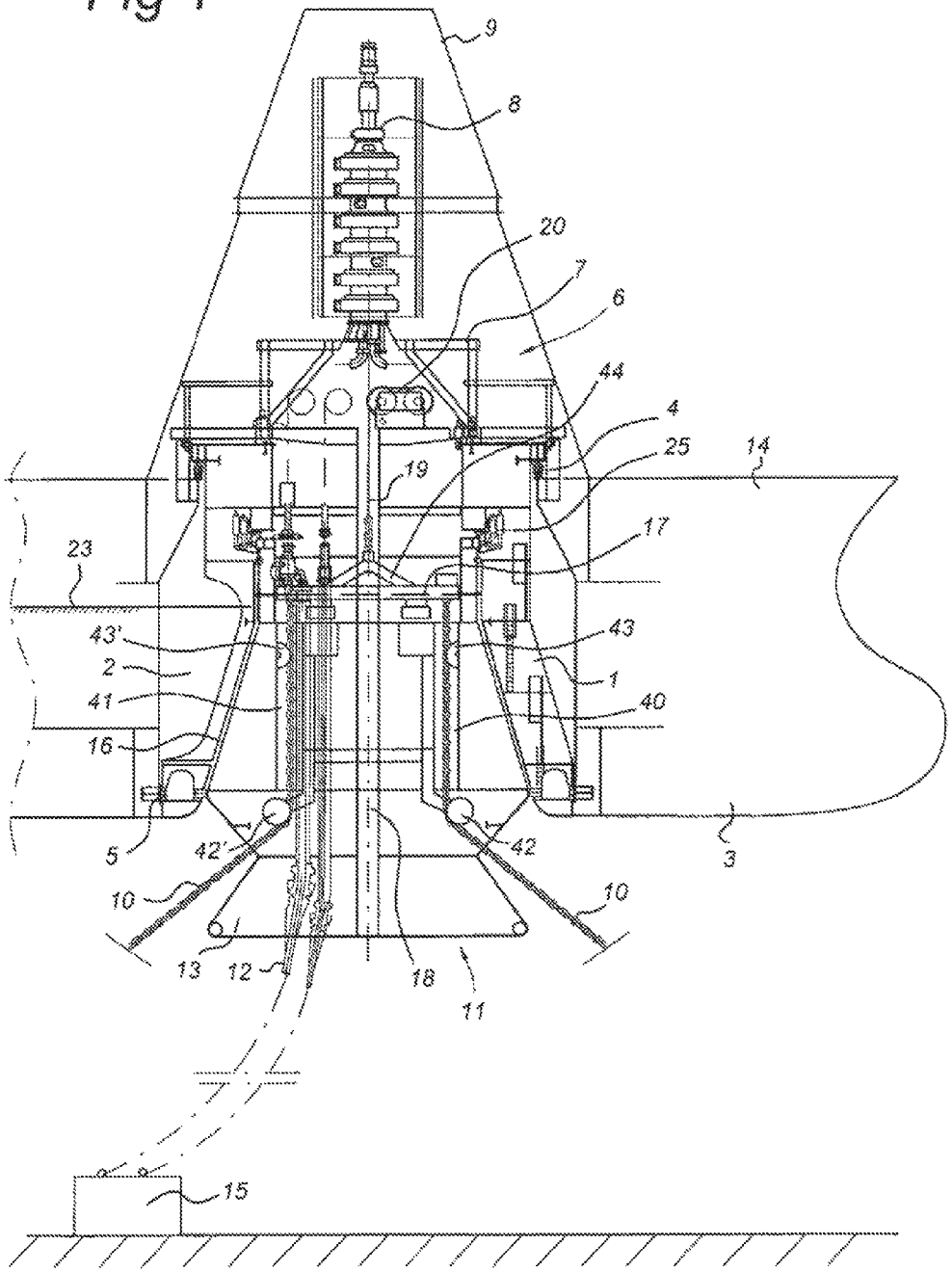
FIG. 1 shows a schematic cross-sectional view of a vessel according to the present invention.

FIG. 1 shows a sectional view of a disconnectable turret mooring system according to the present invention.

The system consists of a cylindrical turret structure 1 located within a cylindrical moonpool 2 integrated into the hull 3 of a vessel 14, which for example could be a FPU or FPSO. The turret bearing system connecting and aligning the turret to the moonpool of the vessel consists of a large diameter top bogie bearing 4 and (optionally) a bottom low friction pad radial bearing system 5.

A large multi-deck superstructure 6 is located on top of the turret 1 and houses installation and production equipment, piping manifolds 7 and the fluid/gas swivel stack 8 for the incoming production fluids, exported fluids and the control/chemical umbilicals.

A steel frame is positioned above and around the superstructure. A casing 9, which is connected to the vessel, supports the piping extending from the fluid swivel stack 8 to the FPU, provides access to the turret 1 from the vessel, drives the rotating part of the swivel and supports the wintering panels. The turret design allows for maintenance and repair in operation, which maximizes its availability over the full field design life.

The upper end of each anchor leg 10, via which the vessel 14 is moored to the sea bed 15, is directly connected to a low friction articulated universal joint on the hull of a mooring buoy 11 that is seated in a conical cavity 16 at the lower end of the turret 1. Risers 12 that are connected to a sub sea hydrocarbon wellhead 15 are with their upper ends connected to a riser deck 17 of the buoy 11. When the mooring buoy 11 is connected to the vessel or FPU, the upper end of the buoy is clamped into the cavity via hydraulic clamps 25. The riser deck 17 is elevated above the maximum vessel draft level 23. This will ensure that under all conditions, the piping equipment is kept permanently in a dry environment to ease access and maintenance.

The mooring buoy 11 has two different functions. Firstly, when the vessel 14 is connected to the buoy 11, the buoy transfers the mooring loads of the anchor lines 10 which are connected to its outer shell. Secondly, when the vessel is disconnected from the mooring buoy 11, the mooring buoy falls down to a depth at a predetermined distance below sea level and supports the anchor lines 10 and risers 12 at this depth. The pre-determined depth can be calculated for example 30-35 meters below water level so that the disconnected buoy stabilizes under the wave active zone. In ice and iceberg infested waters for example, the buoy could be stabilized at a distance of even more than 100 m below water level to avoid any contact with ice-bergs.

The mooring buoy structure 11 comprises a stiffened cylindrical shell with watertight internal bulkheads that divide the buoy into compartments. The center of the buoy incorporates a thick walled inner cylinder 18 to house and guide the hauling in or connecting cable 19 that is attached to a winch 20. The top part of the buoy is fitted with an annular connecting ring on which structural connector ratchets 25, 25' that are placed within the turret can be locked. I-tubes 21 may in one embodiment be fitted in the center of the buoy, for risers and sub-sea umbilicals and are terminated at the bottom end of the buoy 11 to support the riser/umbilical bell-mouths. Risers bend stiffeners and bell-mouths are protected from ice drifting under the vessel hull by a conical skirt 13 at the bottom of the mooring buoy. Alternatively there also can be protection means against ice like a skirt or fence placed at the bottom of the vessel to protect the moonpool against ice ingress when the vessel is disconnected or to protect the buoy and risers when the mooring buoy is connected to the turret.

The buoyancy required for keeping the risers 12 and anchor legs 10 at the specified level in the disconnected state is provided by central compartments and compartments fitted on the buoy periphery.

The structural arrangement is such that it minimizes the contact between the buoy hull and the turret parts during disconnection, so that there is no risk of accidental flooding. Nevertheless the watertight buoy is compartmented in order to ensure sufficient buoyancy in case of accidental flooding of one compartment.

When the locking members, or hydraulic clamps 25 are disengaged, the buoy 11 is released from the cavity 16 and will sink to a predetermined depth below water level 23. For reconnecting the buoy 11 to the vessel 14, the vessel 14 will slowly approach the submerged mooring buoy 11 until a floating pick-up line, that is coupled to a part of the pull-in line 19 that remains attached to the buoy 11 and stored within cylinder 18 can be grappled. The two sections of the pull-in line 19 are then shackled together, the floating pick-up line is removed and the pull-in line 19 is returned over the side. In case of reconnection with ice above, connection of the pull-in line segments will be carried out directly in the dry part of the turret moonpool.

The traction winch 20 is operated such that the mooring buoy 11 is slowly lifted below the vessel 14 and into the cavity 16 of the turret until the buoy top flange will be in contact with the structural connector centralizer. The clamps 25 of the structural connector will be closed and the mechanical locks activated. The vessel is now securely reconnected and moored via the turret 1 to the anchor legs 10 of the mooring buoy 11.

The anchor lines 10 extend upward through vertical channels 40,41 through the buoy 10, along anchor line guides 42,42' and 43,43'—which may comprise sheaves—, at the lower and upper ends of the buoy 10 to be deflected from an inclined orientation to a substantially vertical orientation. At their upper ends, the anchor lines 10 are connected to a frame 44 that is attached to the pull-in line 19. The frame 44 forms a stopper member, which rests on abutment surface of the buoy 11 in the connected state shown in FIG. 1 such that the weight of the anchor lines 10 and risers 12 is supported by the buoy. During connection of the buoy 11, the anchor lines are pulled upwards via the frame 44 and the buoy rises in view of its buoyancy. The buoy 11 can move relative to the anchor lines 10, in view of the vertical channels 40,41 through which the anchor lines are movably guided via anchor line guides 42,42', 43,43'. In this manner tension is maintained on the pull-in line 19 during heave-induced motions of the vessel 14 and snatch loads on the pull-in line-19 are prevented. After attaching the buoy 11 into the cavity 16, the frame 40 is supported on top of the buoy, which at its top comprises an abutment surface for supporting the frame 40. Upon decoupling of the buoy 11 from the cavity 16, the frame 40 remains rested against the top of the buoy and the buoy and anchor lines sink to a predetermined depth below water level 23, preferably below the wave active zone.

The mooring buoy 11 is connected without any considerations about its rotational position. Only after the vessel 1 has been safely moored to the buoy 11, a turntable 31 with the complete turret manifold 7 is rotated to match the piping orientation on the buoy, as has been shown in detail in FIG. 2. The fact that the complete manifold 7 can be orientated with regard to the turret 1 will avoid performing the alignment of the manifold piping with the mooring buoy piping at a critical stage of the reconnection when the buoy 11 is connected to the traction winch 20 only and is not yet securely moored to the turret 1.

Figure 2:
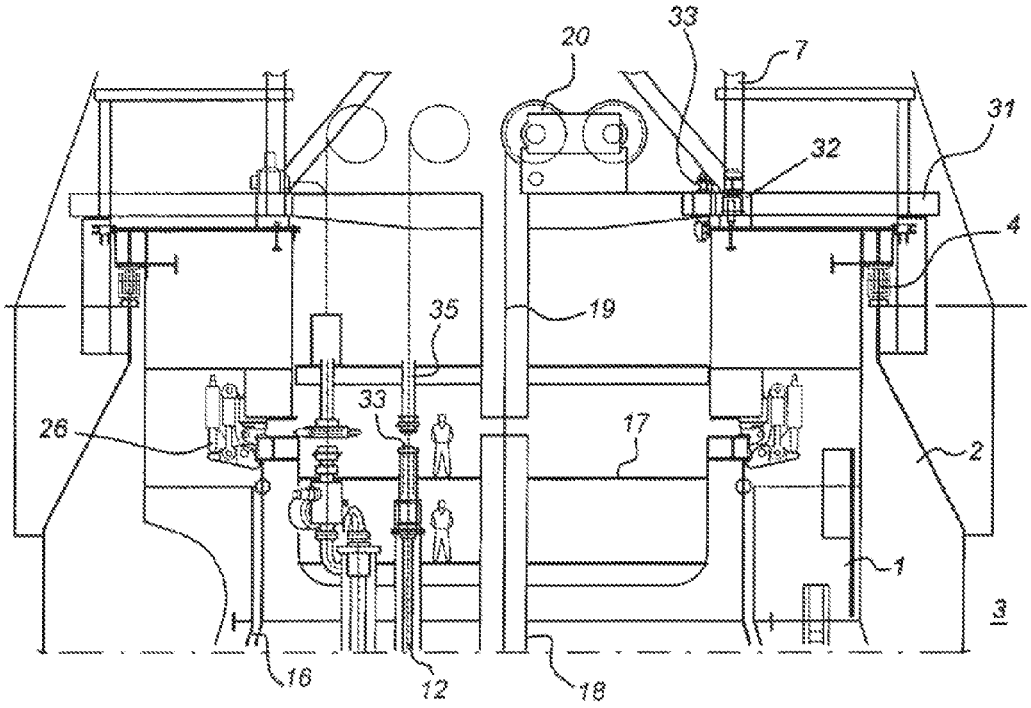
FIG. 2 shows a detail of the upper part of the buoy of FIG. 1 on an enlarged scale.

As has been shown in more detail in FIG. 2, in order to be rotated around a vertical axis, the manifold structure 7 in the turret 1 is unlocked, a temporary turntable bearing system 32 is activated by displacing it in a vertical direction, such that turntable 31 is lifted from turret land a turntable orientation motor is started. By slowly rotating the turntable 31, the turret manifold 7 is brought into the correct orientation wherein manifold pipe ends are brought inline with the mooring buoy riser pipe ends. This operation will be monitored from the control panel of the motor and will be controlled from the manifold lower deck. Once the correct turntable orientation has been achieved the turntable manifold will be automatically locked and the temporary turntable bearing system deactivated by displacing the bearing wheels 32 hydraulically in a vertical direction by a few mm so that the lifted and orientated turntable 31 rests again on the turret 1 in a fixed rotational position.

The flow lines, or piping 35, down stream of the fluid connectors 33 at the interface of the buoy 11 and the cavity 16, will then be lowered back to their operating position. The fluid connectors 33 interconnecting the ends of the risers 12 and the piping 35 of manifold 7 will be closed and leak tested. Once the isolation valves are opened production can recommence. The umbilicals will be connected using a similar procedure.

Figure 3:
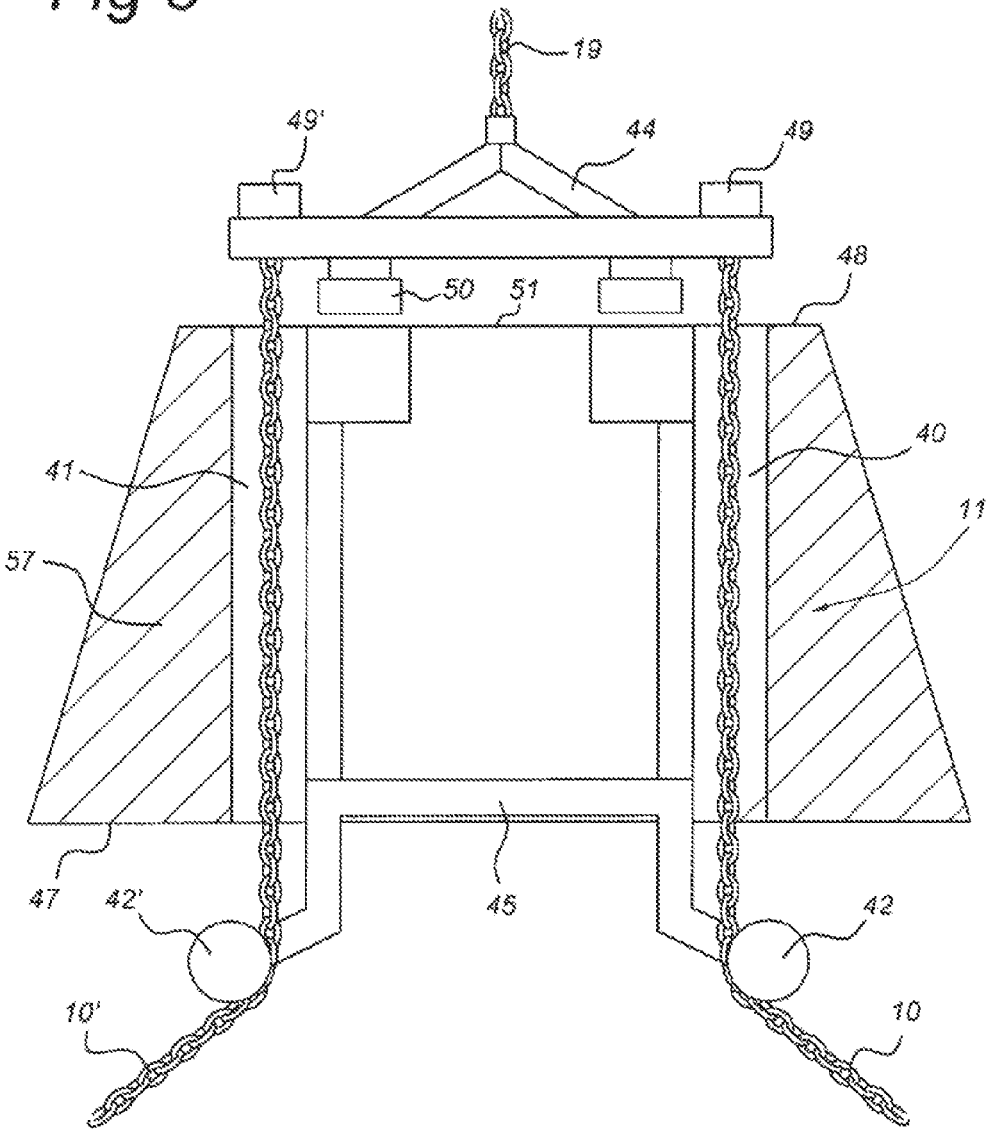
FIG. 3 shows an embodiment of a movable connection of the buoyant body to the anchor lines that are comprised in vertical channels.

In the embodiment that has been shown in FIG. 3, the buoy 11 comprises a buoyant a body 57 having vertical channels 40, 41. The buoy 11 comprises at its lower end 47 a lower circular frame 45 carrying the chain sheaves 42, 42'. The frame 45 can rotate relative to the buoyant body 57 around a vertical axis. At the upper end 48 of the buoy, the anchor lines 10, 10' are attached to the frame 44 via chain stoppers 49,49'. By rotation of the frame 45, the sheaves 42,42' remain aligned with the chain stoppers 49, 49'. On the circular frame 44 resilient bumper devices 50 may be provided for contacting the reinforced abutment surface 51 at the top of the buoy 11. In the connected state, when the buoy 11 is attached to the cavity 16 of the vessel, the bumper devices 50 contact the surface 51 to transfer the weight of the anchor lines 10, 10' and risers 12 to the buoy 11. Also upon disconnection of the buoy 11. from the cavity 16, the bumper devices 50 are engaged with the upper buoy surface 51.

Figure 4A:
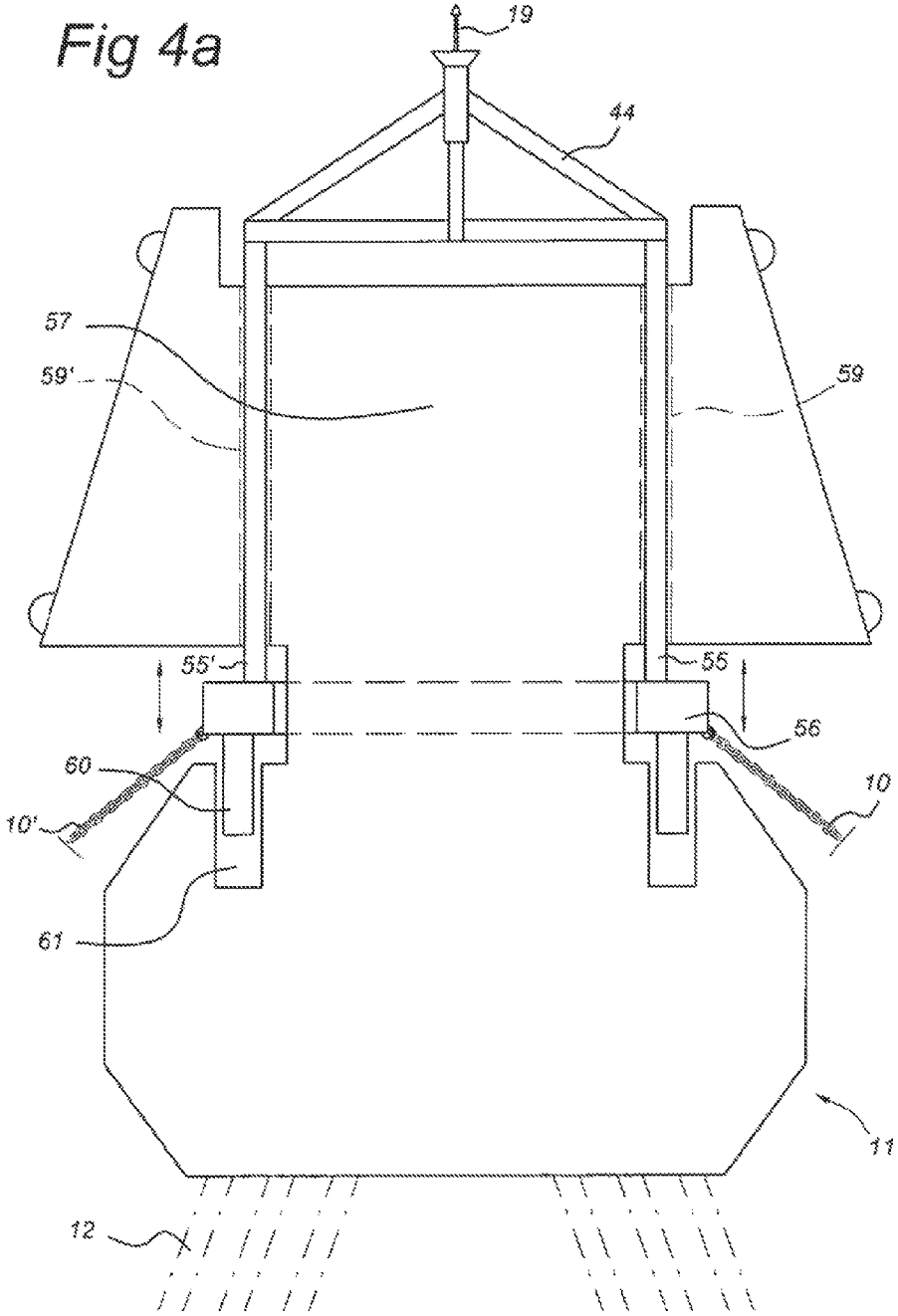
FIGS. 4*a* and 4*b* show an alternative embodiment of a movable connection of the buoyant body to the anchor lines via vertical frame members.

FIGS. 4 and 4*a* show an alternative embodiment in which the frame 44 comprises vertical frame members 55,55' connected to a lower stopper 56 to which the upper ends of anchor lines 10, 10' are attached. The vertical frame members 55,55' can move relative to they buoyant body 57 of the buoy 11 via vertical channels 59,59'. The vertical frame members 55, 55' and/or the stopper 56 come to rest on the buoyant body 57 of the buoy 11 in the disconnected state in a non-rotating manner such that no yaw rotation of the buoyant body 57 relative to anchor lines 10, 10' can occur. For preventing yaw motion of the frame 44 relative to the buoyant body 57, the stopper 56 may comprise protrusions 60 fitting into recesses 61 on the buoyant body 57.

Figure 4B:
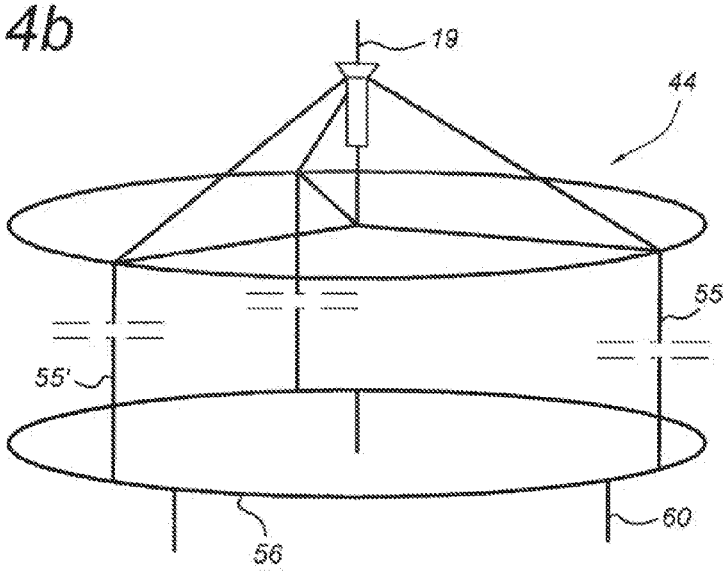

FIG. 4*b* shows the rigid cage-like construction of the frame 44, the vertical members 55,55 and the stopper 56 at the lower end of frame 44.

Figure 5:
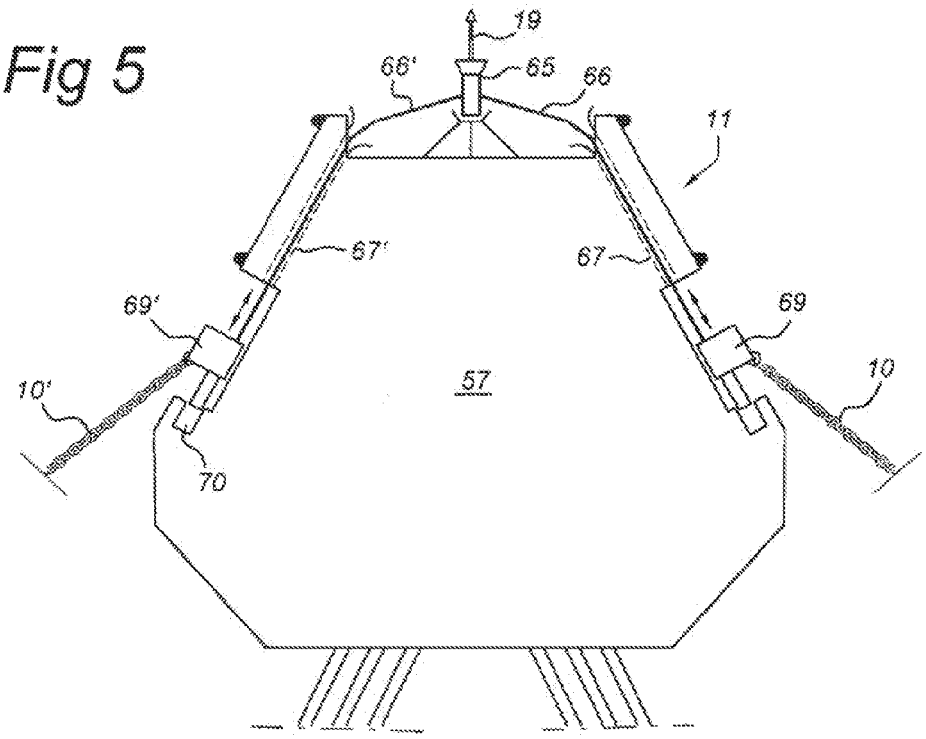
FIG. 5 shows a further embodiment of a movable connection of the buoyant body to the anchor lines via pulling cables running in channels in the buoyant body.

FIG. 5 shows an embodiment wherein an upper connector 65 is attached to cables 66, 66' extending in inclined channels 67, 67' in the buoyant body 57 of the buoy 11. The cables 66, 66' are connected to stoppers 69, 69' attaching to the upper ends of anchor lines 10, 10'. The stoppers 69, 69' can engage with a recess 70 on the buoyant body 57 to prevent yaw rotation of the buoyant body 57 relative to the anchor lines 10, 10'.

Figure 6:
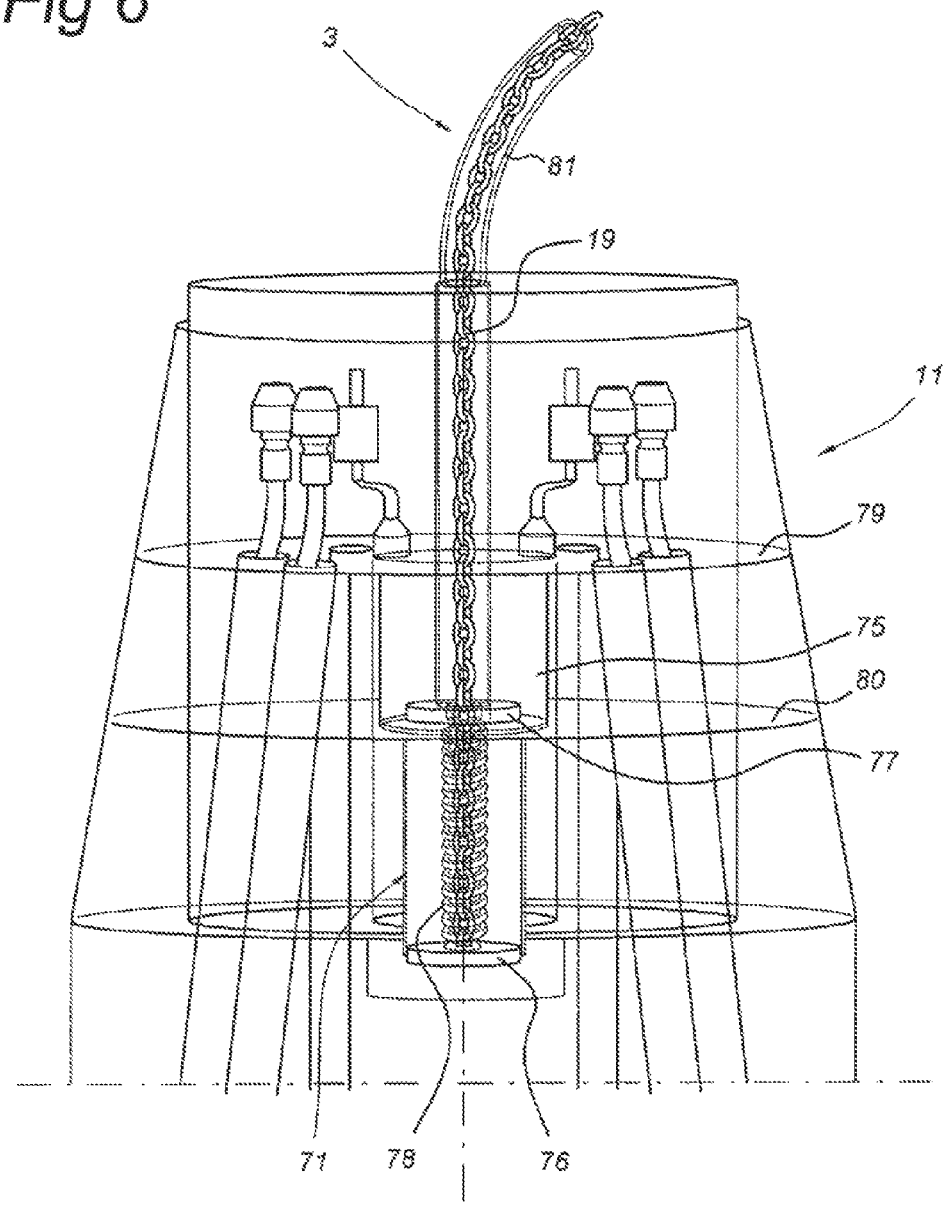
FIG. 6 shows an embodiment according to the invention of a resilient shock absorber attached to the pull-in line.

FIG. 6 shows an embodiment wherein the pull-in line 19 is attached to a shock-absorbing device 71, comprising a lower flange 76, an upper flange 77 and a cylindrical compression spring situated between the flanges 76,77. The pull-in line 19 is attached to the lower flange 76. When the buoy 11 is pulled upwards by the pull-in line 19, the upper flange 77 of the shock-absorption device 70 comes to rest against deck 79 and the upward force exerted on the lower flange 76 by the pull-in line 19 compresses the spring 78. The buoy moves upwards while the spring 78 remains in its compressed stated. Release of the tension on the pull-in line 19, for instance due to heave movements, causes the spring 78 to expand such that any slack in the pull-in line 19 is taken up. In the embodiment shown in FIG. 6, the pull-in line goes slack when the buoy is connected to the cavity 16 of the vessel, or when the buoy 11 is allowed to descend after disconnection from the cavity, and the upper flange 77 comes to rest on deck 80. The chain 19 may be collected in central compartment, or chain locker 80.

Near the upper part of the buoy 11, the chain 19 is provided with a sheath 81, which may be formed by a flexible hose that is slightly larger than the chain width. The sheath 81 prevents the chain 19 from collapsing onto the op of the buoy 11 when the chain 19 goes slack and prevents the chain from damaging the top part of the buoy 11.

The invention claimed is:

1. Vessel (14) comprising a hull (3) having a turret (1), a cavity (16) in the turret and a mooring buoy (11) releasably attached in the cavity, the buoy comprising a buoyant body (57) and carrying a number of risers (12) extending to a subsea hydrocarbon well and a number of anchor lines (10,10') connected to the sea bed, wherein upon connection of the buoy to the cavity, the buoy is attached to a pulling member (19) connected to a winch (20) on the vessel for lifting of the buoy, wherein the pulling member (19) is connected to the buoy (11) via a resilient compression device (71), and wherein the compression device (71) comprises an upper flange (77) and a lower flange (76) and a compression spring (78) extending between the flanges, the pulling member (19) being attached to the lower flange (76), the upper flange being engageable with a stop member (79) upon lifting of the buoy, the spring being compressible by upward movement of the lower flange by the pulling device.

2. Vessel according to claim 1, the pulling device (19) being near a top part of the buoyant body provided with a flexible sheath (81).

* * * * *